US010240593B2

(12) United States Patent
Stephens

(10) Patent No.: US 10,240,593 B2
(45) Date of Patent: Mar. 26, 2019

(54) SYSTEMS AND METHODS OF CONTROLLING PRESSURE MAINTENANCE PUMPS AND DATA LOGGING PUMP OPERATIONS

(75) Inventor: Douglas A. Stephens, Cary, NC (US)

(73) Assignee: ASCO Power Technologies, L.P., Florham Park, NJ (US)

( * ) Notice: Subject to any disclaimer, the term of this patent is extended or adjusted under 35 U.S.C. 154(b) by 921 days.

(21) Appl. No.: 13/410,574

(22) Filed: Mar. 2, 2012

(65) Prior Publication Data

US 2012/0230846 A1 Sep. 13, 2012

Related U.S. Application Data

(60) Provisional application No. 61/449,202, filed on Mar. 4, 2011.

(51) Int. Cl.

| | |
|---|---|
| ***F04B 49/06*** | (2006.01) |
| ***F04B 49/02*** | (2006.01) |
| ***A62C 37/50*** | (2006.01) |
| ***F04B 49/08*** | (2006.01) |
| ***A62C 37/36*** | (2006.01) |

(Continued)

(52) U.S. Cl.

CPC ..... *F04B 49/065* (2013.01); *A62C 3/00* (2013.01); *A62C 37/04* (2013.01); *A62C 37/50* (2013.01); *F04B 49/022* (2013.01); *F04B 49/08* (2013.01); *A62C 35/58* (2013.01); *F04B 23/04* (2013.01); *F04B 41/06* (2013.01); *F04B 51/00* (2013.01);

(Continued)

(58) Field of Classification Search

CPC ..... F04B 49/065; F04B 2205/03; F04B 2205/05; F04B 41/06; F04B 51/00; F04B 23/04; F04B 49/08; F04B 49/022; A62C 35/58; A62C 3/00; A62C 35/60; A62C 35/605; A62C 35/00; A62C 37/00; A62C 37/04; A62C 37/50

See application file for complete search history.

(56) References Cited

U.S. PATENT DOCUMENTS

| | | | |
|---|---|---|---|
| 3,748,656 A | 7/1973 | Gray et al. | |
| 5,035,357 A | 7/1991 | Brickell et al. | |

(Continued)

FOREIGN PATENT DOCUMENTS

| | | | | |
|---|---|---|---|---|
| EP | 1702655 A1 | | 9/2006 | |
| JP | 2009008091 A1 | | 1/2009 | |
| WO | WO2008084077 | * | 7/2008 | ..... F04B 51/00 |

OTHER PUBLICATIONS

MC9S08.pdf, MC9S08QG8/4 Data Sheet, Copyright 2006, freescale semiconductor, Inc., found at: http://www.physics.mcmaster.ca/phy4d6/MCU/MC9S08/MC9S08QG84FS%20Fact%20Sheet.pdf.*

(Continued)

*Primary Examiner* — Bryan Lettman

(74) *Attorney, Agent, or Firm* — McDonnell Boehnen Hulbert & Berghoff LLP

(57) ABSTRACT

Controlling the operation of a jockey pump in a fire pump system including a jockey pump controller which includes an electronic circuit board configured to receive a signal indicating a pressure value, and compares the pressure value to a threshold for initiating operation of the jockey pump. The jockey pump controller may further include memory configured to store event statistics indicating information regarding past operation of the jockey pump.

16 Claims, 10 Drawing Sheets

(51) Int. Cl.

| | |
|---|---|
| ***A62C 3/00*** | (2006.01) |
| *F04B 23/04* | (2006.01) |
| *F04B 41/06* | (2006.01) |
| *A62C 35/58* | (2006.01) |
| *F04B 51/00* | (2006.01) |

(52) U.S. Cl.
CPC ..... *F04B 2205/03* (2013.01); *F04B 2205/05* (2013.01)

(56) References Cited

U.S. PATENT DOCUMENTS

| | | | | |
|---|---|---|---|---|
| 5,236,049 | A | 8/1993 | Asselin et al. | |
| 5,460,196 | A | 10/1995 | Yonnet | |
| 5,486,286 | A * | 1/1996 | Peterson et al. | 210/87 |
| 5,577,890 | A | 11/1996 | Nielsen et al. | |
| 5,680,329 | A * | 10/1997 | Lloyd | A62C 37/50 137/551 |
| 5,729,698 | A | 3/1998 | Stelter | |
| 5,950,150 | A | 9/1999 | Lloyd et al. | |
| 5,982,274 | A | 11/1999 | Stelter et al. | |
| 6,221,263 | B1 | 4/2001 | Pope et al. | |
| 6,273,686 | B1 | 8/2001 | Kroell et al. | |
| 6,856,251 | B1 | 2/2005 | Tietsworth et al. | |
| 6,890,156 | B2 * | 5/2005 | Watson | F04B 47/022 417/42 |
| 6,992,590 | B1 | 1/2006 | Tietsworth et al. | |
| 7,320,225 | B2 * | 1/2008 | Street et al. | 62/126 |
| 2005/0183868 | A1 | 8/2005 | Taylor et al. | |
| 2009/0150121 | A1 * | 6/2009 | Takeda | F04D 27/001 702/182 |
| 2009/0188567 | A1 * | 7/2009 | McHugh | A62C 35/68 137/15.05 |
| 2009/0266563 | A1 * | 10/2009 | Wright et al. | 169/13 |
| 2010/0138054 | A1 * | 6/2010 | Goupil | 700/282 |
| 2010/0293933 | A1 * | 11/2010 | Wagner | F04B 51/00 60/327 |
| 2011/0052423 | A1 * | 3/2011 | Gambier | F04B 49/065 417/63 |

OTHER PUBLICATIONS

Firetrol, Inc., Instructions, Digital Pressure Monitor, FTA470, Publication N5470-01 Rev. A (Oct. 20, 2000).

Torna Tech, JP Model, Jockey Pump Controller, Full voltage across the line starter Micro Processor Based, JP-BRO-001/E Rev.4 (Sep. 4, 2003).

U.S. Appl. No. 12/626,781, Office Action dated Sep. 30, 2011 (dated Sep. 30, 2011).

U.S. Appl. No. 12/626,781, Office Action dated Jun. 8, 2012 (dated Jun. 8, 2012).

English Translation of First Office Action issued in Chinese Patent Application No. 201220080873.4 dated Aug. 1, 2012.

English Translation of First Office Action issued in Chinese Patent Application No. 201210059063.5 dated Mar. 18, 2015.

English Translation of Second Office Action issued in Chinese Patent Application No. 201210059063.5 dated Dec. 8, 2015.

* cited by examiner

SYSTEMS AND METHODS OF CONTROLLING PRESSURE MAINTENANCE PUMPS AND DATA LOGGING PUMP OPERATIONS

FIELD OF THE PRESENT PATENT APPLICATION

This present patent application relates to a programmable controller for a pressure maintenance pump or make-up pump, also referred to generally in the art as a jockey pump. More specifically, the present patent application is directed to systems and methods for controlling such maintenance pumps and data logging its operation within a pump system, such as a fire pump system.

BACKGROUND

A fire protection system may comprise a sprinkler system and/or a standpipe system. A sprinkler system is an active fire protection measure that provides adequate pressure and flow to a water distribution piping system, onto which a plurality of fire sprinklers are connected. Each closed-head sprinkler can be triggered once an ambient temperature around the sprinkler reaches a design activation temperature of the individual sprinkler head. In a standard wet-pipe sprinkler system, each sprinkler activates independently when the predetermined heat level is reached. Because of this, the number of sprinklers that operate is limited to only those near the fire, thereby maximizing the available water pressure over the point of fire origin. A standpipe system is another type of fire protection measure consisting of a network of vertical piping installed in strategic locations within a multi-story building for delivering large volumes of water to any floor of the building to supply firefighter's hose lines.

FIG. 1 illustrates a block diagram of a prior art fire protection system 100. The fire pump 102 boosts the water pressure of the water supply by transferring energy to the water. The increase in water pressure acts to move the water into the fire protection system 120. The fire pump controller 108 serves to automatically govern, in some predetermined manner, the starting and stopping of the fire pump driver 102 and to monitor and signal the status and condition of the fire pump unit consisting of a fire pump and driver 102, the controller 108, and accessories. The pressure maintenance pump 106 serves to maintain the pressure on the fire protection system 120 between preset limits when the fire pump is not flowing water. The pressure maintenance pump controller 110 serves to automatically govern, in some pre-determined manner, the starting and stopping of the maintenance pump 106 and to monitor and signal the status and condition of the maintenance pump unit consisting of a maintenance pump and driver 106 and controller 110. Check valves 121 are used in the fire pump installation to allow the flow of water in one direction only for the purpose of building pressure in the fire protection system 120. Check valves are installed between the outlets of each of the pumps and the fire protection system. Gate valves 122 are installed on the inlets and outlets of each of the pumps and are used to isolate either of the two pumps from the fire protection system for maintenance purposes.

The output of this maintenance pump is connected to the system side of the check valve in a typical fire pump installation. The pump's main function is to maintain system water pressure by automatically cycling between pressure set points. That is, the pump will maintain water pressure in the fire protection system by automatically cycling on and off between predetermined, independent START and STOP pressure settings. In this way, the jockey pump functions to make up for small leaks in the system and thereby helps to prevent the larger fire pump from nuisance cycling. Ordinarily, then, the START and STOP settings of the jockey pump are set well above those of the fire pump so that the jockey is cycling to maintain pressure against normal leaks.

The fire pump installation 100 includes a fire pump 102 that is connected to a water supply 104 by way of a gate valve. The water supply 104 provides water flow at a pressure to sprinkler system risers and hose standpipes. Generally, fire pumps are needed when the water supply cannot provide sufficient pressure to meet hydraulic design requirements of the fire sprinkler system. This usually occurs in a building that is tall, such as in high-rise buildings, or in systems that require a relatively high terminal pressure at the fire sprinkler to provide a large volume of water, such as in storage warehouses.

The fire pump 102 starts when a pressure in the fire protection system 120 drops below a certain predetermined start pressure (low pressure). The pressure in the fire protection system 120 may drop significantly when one or more fire sprinklers are exposed to heat above their design temperature, and opens, releasing water. Alternately, fire hose connections to standpipe systems may be opened by firefighters causing a pressure drop in the fire protection system. The fire pump 102 may have a rating between 3 and 3500 horsepower (HP).

The fire pump installation 100 also includes a pressure maintenance pump 106 (also may be referred to herein as a make-up pump or a jockey pump). This pump is intended to maintain pressure in a fire protection system so that the larger fire pump 102 does not need to constantly run. For example, the jockey pump 106 maintains pressure to an artificial level so that the operation of a single fire sprinkler will cause a pressure drop that will be sensed by a fire pump controller 108, causing the fire pump 102 to start. The jockey pump 106 may have a rating between ¼ and 100 horsepower (HP).

The jockey pump 106 may maintain pressure above the pressure settings of the larger fire pump 102, so as to prevent the main fire pump from starting intermittently. For example, the jockey pump 106 provides makeup water pressure for normal leakage within the system (such as packing on valves, seepage at joints, leaks at fire hydrants), and inadvertent use of water from the water supply. When the fire pump 102 starts, a signal may be sent to an alarm system of the building to trigger the fire alarm. Nuisance operation of the fire pump 102 eventually causes fire department intervention. Nuisance operation of the fire pump 102 also increases wear on the main fire pump 102. Thus, it is generally desired to either reduce and/or avoid any nuisance or unintended operation of the fire pump 102.

In the United States, the application of the jockey pump 106 in a fire protection system is provided by NFPA 20: Standard for the Installation of Stationary Pumps for Fire Protection, which prohibits a main fire pump or secondary fire pump from being used as a pressure maintenance pump.

Each of the fire pump 102 and the jockey pump 106 include a pump controller 108 and 110, which may comprise a microprocessor-based controller that can be used to adjust start and stop set points.

As just one example, as early as January 2001, microprocessor-based jockey pump controllers were provided by Firetrol, Inc. of Cary, N.C. These microprocessor-based pump controllers or jockey pump controllers were typically housed in an industrial enclosure, included a digital display and received pressure information by way of a solid state pressure sensor, typically via 1-5 Vdc. Such digital controllers were used to monitor water pressure in the fire protection system, and also allowed user manipulation of certain programmable pumping operations for the control of one, two (duplex) or three (triplex) booster pump systems. Using the electronic pressure monitors, water pressure can be measured with a pressure transducer providing an output of 1-5 Vdc for ranges of 0-300 and 0-600 psi. Operation of the one to three pumps could be independently controlled via programmable digital set points. Such digital set points for each pump include start and stop pressures, and on-delay, minimum run, and off-delay timers. An additional output is provided for a call to start indicating a low pressure condition, and a remote stop/reset input is provided for reset of all timing functions. The digital pressure monitor may be configured for use in simplex, duplex, triplex, and pump up or pump down applications.

The jockey pump controller 110 may have a start pressure set point of approximately five to ten pounds per square inch greater than the start pressure set point in the fire pump controller 108. In this manner, the jockey pump controller 110 cycles the jockey pump 106 to maintain the system at a predetermined pressure well above the start setting of fire pump 102 so that the fire pump only runs when a fire occurs or the jockey pump 106 is overcome by a larger than normal loss in system pressure.

FIG. 2 illustrates a prior art microprocessor based duplex jockey pump controller 200, such as the Firetrol electronic pressure monitor sold under the tradename of "Digital Pressure Monitor FTA470." This prior art jockey pump controller 200 includes a solid state electronic pressure transducer 202 connected to three analog input pins on the microprocessor controller 204. The pressure transducer measures water pressure and provides an output signal of 1-5 Vdc to the microprocessor controller 204. For example, such solid state pressure transducer could comprise the Model SP975 manufactured by Senso-Metrix. The microprocessor controller 204 outputs a lag pump start/stop signal, a lead pump start/stop signal, and a pump run signal.

The jockey pump controller 200 provides for programmable timing functions, pressure set points, offset and scaling calibration, and pump up and pump down options. Lag and lead pump output signals are provided to energize relays for starting their pumps when pressure drops below a start pressure set point and remain energized until pressure is satisfied at a stop pressure set point. On-delay timers may be programmed in microprocessor controller 200 to provide time delays in starting the pumps upon a call to start (i.e., low pressure). Since these timers are reset if pressure returns to stop pressure, on-delay timers are often used to provide a sincerity check on low pressure for eliminating nuisance starting due to pressure excursions in the fire protection system.

The prior art jockey pump controller 200 further comprises a digital panel display. FIG. 3 is an illustration of the prior art digital panel display that may be used with certain prior art microprocessor jockey pump controllers, such as the controller illustrated in FIG. 1. The digital panel display comprises one or more LED indicators. Such LED indicators could be used for a single digit pump number, a four digit pressure, and a red LED for setup mode, a green LED for run mode, a red LED indicating a call to start (low pressure) in the run mode, a yellow LED indicating on-delay timing sequence in run mode, a yellow LED indicating minimum run timing sequence in the run mode, a yellow LED indicating off-delay timing sequence in the run mode, a green LED indicating stop pressure in the run mode, and a green LED indicating AC power is on. The digital panel display also includes buttons to program the jockey pump controller, such as pump select, mode select, up/down selection arrows, and enter. A second single digit LED display (Pump No.) is provided to indicate which pump is being monitored in a multiple jockey pump installation. A modbus RS 485 serial communications port is provided for the transmission of the pressure value and pressure set points to a master host.

In operation, relays of these prior art electronic digital pressure monitors operate independently based upon an individual start and stop pressure set points. In a system configured for pump up, such as a jockey pump application, the monitor illuminates the "start" LED when system pressure falls below the start set point (low pressure). The pressure monitor energizes the relay to run the first pump provided the on-delay timer is set to zero seconds. If the on-delay timer is set greater than zero, the monitor illuminates the "on delay" LED to start the on-delay timing sequence and delays starting the first pump for the on-delay period. The on-delay timer is immediately reset if pressure becomes satisfied. If the minimum run timer is set to a value greater than zero minutes, the monitor illuminates the "min. run" LED to start the timing sequence and runs the pump for the minimum run period. At the end the minimum run period, the monitor extinguishes the LED and de-energizes the relay to shut off the first pump provided that system pressure is satisfied. Otherwise, the monitor continues running the first pump until pressure is satisfied. If the off-delay timer is set to a value greater than zero minutes, the monitor illuminates the "off-delay" LED to start the off-delay timing sequence after pressure is satisfied. The monitor continues running the pump until the off-delay time expires whereupon the monitor de-energizes the relay to shut off the first pump. Off-delay and minimum run timers are mutually exclusive. To prevent short cycling, a default run time may be used. Additional pumps operate in the same manner with independent start and stop set points.

Although such known prior art microprocessor based controllers offered certain advantages based, in part, on their microprocessor based control, such known prior art microprocessor based devices had certain limitations. For example, one drawback of such early digital microprocessor based jockey pump controllers was that they offered limited ability to help maintenance staff with identifying and potentially diagnosing certain causes of intermittent or frequent maintenance pump cycling. For example, such early microprocessor based devices did not provide a method or manner that would allow the controller to log or store certain operating events. As such, it was often time difficult to identify or trace certain system events that would cause the pump to cycle intermittently or perhaps cause the pump motor and hence the pump to trip off due to certain power or electrical failures. As such, by providing certain data event logging features, it would be beneficial to have certain event logging features that could be user accessible so that certain operating conditions (such as continuous jockey pump cycling or undetermined controller shutdown) relative to jockey pump cycling could be captured for trending and analysis. Such information could also beneficially include controller event information related to how the pump cycles during a certain time of day, during a certain time of week, or even during a defined period of time (e.g., during the first week of a winter holiday). Being able to monitor when and how often such a jockey pump cycles and characterize the jockey pump operating conditions during certain time periods could also prove quite beneficial for correct identification and diagnosis of certain maintenance requirements. For example, early diagnostics of causes of varying pressure levels may reduce the amount of time required to diagnose a potential problem that could prevent a future event causing the fire pump to being cycling and causing nuisance problems associated therewith. In addition, enhanced diagnostics by way of event logging and data tracking may also help identify certain operational concerns that may manifest themselves into a potentially catastrophic fire pump system failure. As such, controller event logging and data tracking may help avoid a costly and undesired downtime of the fire pumping system as a whole. Of course, enhanced diagnostics could also help reduce the amount of time that may be required to bring a fire pump system back on line. Enhanced diagnostics could also help reduce installation time and costs where problems can be quickly identified and resolved.

Another advantage of such data and event tracking would also help the long term function of such a pump system, such as a fire pump system, so that leaks and other causes affecting the jockey pump cycle operation could be efficiently and more easily identified thus increasing the life span of the overall system.

In addition, there is general need for enhanced data communications, particularly in a fire pump system and therefore in the fire pump control room. For example, a jockey pump controller having enhanced digital communications capability could also prove quite useful. For example, such enhanced data communications would allow the controller to communicate in real time certain event history data that it accumulates thus allowing either local or remote communication of this data. That is, maintenance and operational diagnostic information could be communicated remotely to a central location such as a local or a regional maintenance center for fire pump system operational control and maintenance. By providing a jockey pump controller with an enhanced data communications module would allow the controller to communicate via a host of digital communication protocols such as, but not limited to Modbus, Modbus Ethernet, CAN, CANOpen, wireless Ethernet, DeviceNet, ProfiBus, BACNet, ARCNet, ZigBee, Bluetooth, and other similar protocol structures.

In addition, there is also a growing demand for increased record keeping data, data gathering, and storage thereby reducing the overall time and upkeep required to maintain a fire pump system. Also, enhanced record keeping can help trouble shoot certain events that may occur in fire pump systems, such as the system illustrated in FIG. 1.

In addition, in certain critical applications, there is a growing need for three phase voltage monitoring of pumping systems, especially those systems installed on or near weak or unstable power grids. In such critical applications, such voltage monitoring could be used to provide protection against premature equipment and/or pump failure caused by phase reversal. Inadvertent phase reversal in certain critical applications, such as in a fire pump system, could have potentially disastrous consequences where certain pump motors are driven in a reverse direction. In addition, such desired three phase voltage monitoring could also be used to provide protection against phase loss, phase reversal, over or under voltage, unbalanced voltage and short cycling. There is, therefore, a general need for a dependable fault sensing and remote alarm annunciation that can be provided by way of a maintenance pump controller, such as a jockey pump controller. In addition, there is also a demand for remote alarm monitoring of pump fail to start and pump motor overload conditions.

SUMMARY

Example devices, systems, and methods disclosed herein relate to controlling the operation and/or event and data logging of a maintenance pump, such as a jockey pump of a fire pump installation system. In one example, a jockey pump controller for controlling operation of a jockey pump of a fire pump system is provided. The jockey pump controller comprises at least one electronic circuit board comprising a programmable microcontroller that is configured to receive a signal indicating a pressure value, and convert it to a digital or binary pressure value. The controller compares the pressure value to at least one threshold where this threshold may be used for initiating operation of a jockey pump by way of a motor, such as a three phase motor. A memory is operatively configured to the programmable microprocessor and may be used to store event statistics representative of maintenance pump operation.

In one preferred alternative arrangement, the jockey pump controller may further comprise an input/output (I/O) expansion module (also an electronic circuit board) that may be directly or indirectly coupled to the electronic circuit board (CPU) of the controller. This input/output (I/O) expansion module or board may be configured for providing the user with remote alarm monitoring capability. The jockey pump controller may further comprise a separate or integral memory device or module that can be configured to store event statistics and other related historical data that can be used to indicate certain information regarding past operation of the jockey pump thus providing enhanced diagnostics, trouble shooting advantages and other related time saving features.

In other examples, a computer readable storage medium having stored therein instructions executable by a computing device to cause the computing device to control operation of a jockey pump of a fire pump installation system is provided. The instructions may be effective to cause the computing device to perform the functions of receiving at an electronic circuit board a signal indicating a pressure value, and comparing the pressure value to a threshold for initiating operation of a jockey pump. In one example, the functions may further comprise receiving at an input/output (I/O) expansion board coupled to the electronic circuit board for providing the user with remote alarm monitoring capability. In some examples, the functions further comprise storing event statistics indicating information regarding past operation of the jockey pump.

In additional examples, a method of controlling operation of a jockey pump of a fire pump system is provided. The method may comprise receiving at an electronic circuit board a signal indicating a pressure value, and comparing the pressure value to a threshold for initiating operation of a jockey pump. In one example, the method may further comprise receiving at an input/output (I/O) expansion board coupled to the electronic circuit board for providing the user with remote alarm monitoring capability. In some examples, the method may comprise storing event statistics indicating information regarding past operation of the jockey pump.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
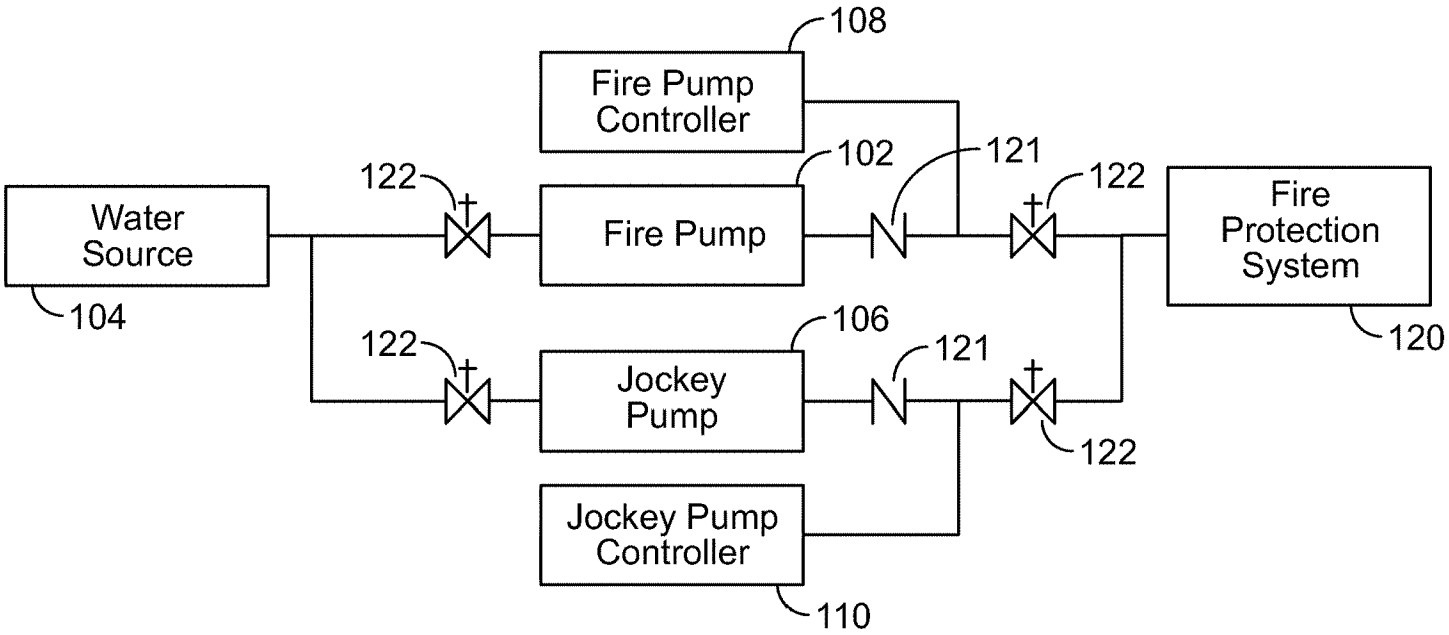
FIG. 1 Prior Art
FIG. 1 is a block diagram of a prior art fire protection system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Example devices, systems, and methods disclosed herein relate to controlling and monitoring operation of a pump of a pump system, such as a jockey pump of a fire pump system. In one illustrated arrangement, a jockey pump controller may include an electronic circuit board configured to receive a signal indicating a pressure value, and to compare the pressure value to a set point for initiating operation of a jockey pump. The jockey pump controller may further include an input/output (I/O) expansion board coupled to the electronic circuit board for providing the user with remote alarm monitoring capability. The jockey pump controller may further include memory configured to store event statistics indicating information regarding past operation of the jockey pump. Additional example devices, systems, and methods are described herein.

Figure 4:
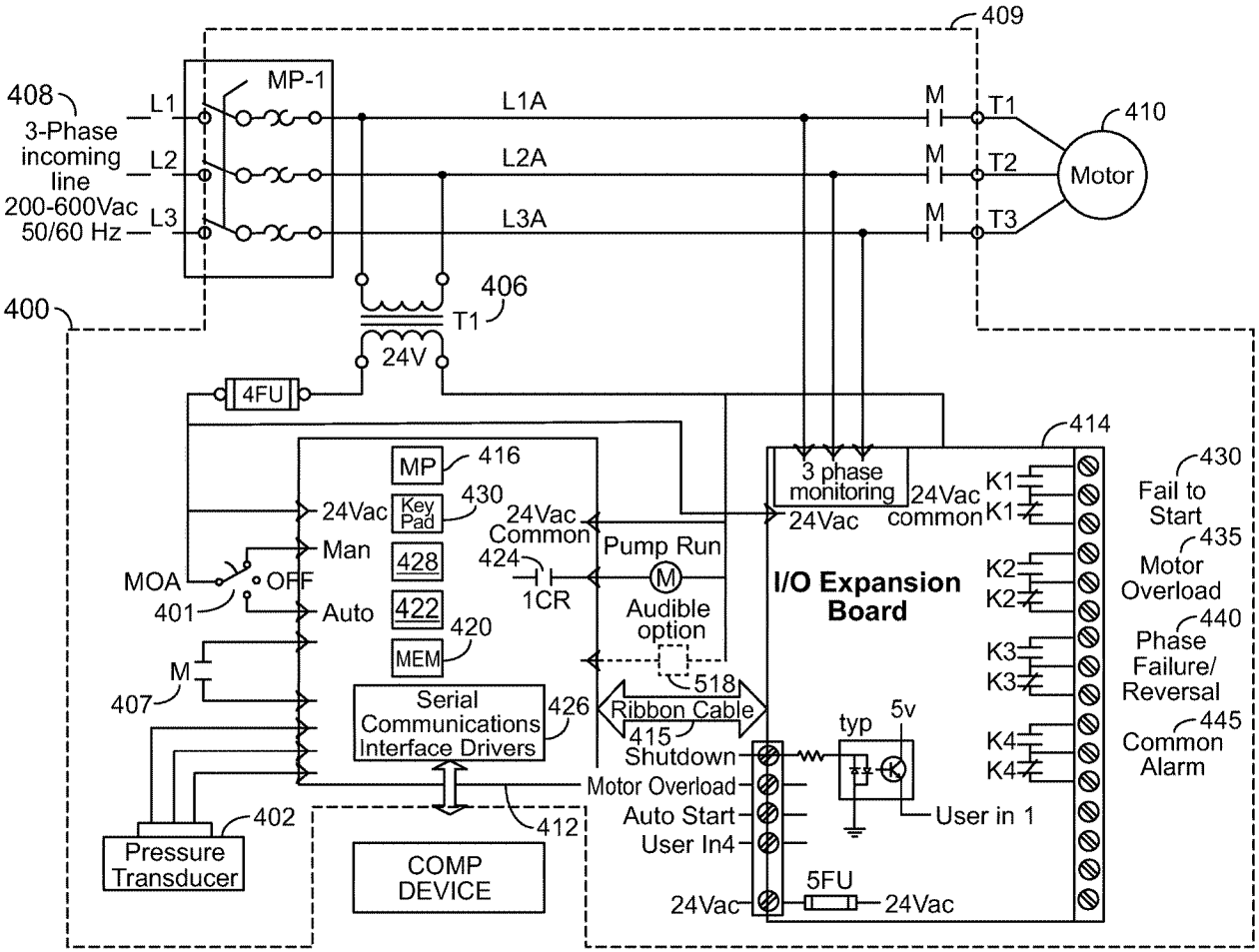
FIG. 4 is a block diagram illustrating an example system configured to maintain water pressure within a pump system.

FIG. 4 is a block diagram illustrating an example system 400 configured to maintain water pressure within a fire water system, such as the system 120 illustrated in FIG. 1. In some examples, the system 400 may include one or more functional or physical components such as a pressure transducer 402, a pump controller 404, a control transformer 406, three-phase incoming line 408, and a motor 410. One or more of the described functions or physical components may be divided up into additional functional or physical components, or combined into fewer functional or physical components.

In some further examples, additional functional and/or physical components may be added to the examples illustrated by FIG. 4. As just one example, as illustrated, the three-phase incoming line 408 may comprise a three phase incoming line 200-600 Vac 50/60 Hz. This incoming line is preferably coupled directly to a motor protector that may comprise a three phase circuit breaker along with adequate overload protection. As also illustrated, the motor may be provided with a three phase contactor. The transformer 406 may comprise a 24 Volt control transformer and include fuse protection.

The pressure transducer 402 is configured to generate a signal as a function of an imposed pressure. For example, returning to FIG. 1, this imposed pressure may be the pressure being monitored on the fire protection system 120 of the pump. As such, the pressure transducer 402 may be positioned at an inlet of a pump in a water system to generate signals as a function of a suction pressure at the inlet of the pump, a discharge pressure at the outlet of a pump, an overall system pressure, or other water pressure, for example. The pressure transducer 402 may be any kind of pressure sensor, and can measure pressure based on any type, such as absolute pressure, a gauge pressure, a differential pressure, or a sealed pressure, for example.

The pressure transducer 402 may be an electronic pressure sensor using a LVDT coupled to a bourdon tube and can be configured to provide user selectable start and stop pressure settings. In other examples, the pressure transducer 402 may be a solid state pressure sensing device, an electromechanical pressure sensing device, or a combination of the two. As just one example, U.S. Pat. No. 5,577,890, entitled "Solid State Pump Control And Protection System" (Issue date Nov. 26, 1996), discloses one type of solid state pressure transducer and is herein entirely incorporated by reference and to which the reader is directed for further information. As disclosed in this prior art reference, one such solid state pressure transducer comprises a semiconductor pressure transducer that includes an integrated circuit which is described as having a four resistor bridge implanted on a silicon membrane, such as part no. 24PCGFM1G available from Micro Switch of Freeport, Ill. (see e.g., Col. 5 Lines 13-16). Alternatively, the solid state pressure transducer Model SP975 from Senso-Metrix may also be used.

In some examples, the pressure transducer 402 may be a 0-300 psi (0-20.69 bars) pressure transducer for fresh water service, or a 0-600 psi (41.38 bars) for other applications. Other examples of pressure transducers includes 0-300 psi, 0-500 psi, 0-600 psi, or 0-1000 psi pressure sensors for fresh water service, sea water/foam service, or other service. Any ranges within or substantially within those described for other pressure sensors may also be used, and the high and low pressure settings may be independent of each other. In one preferred arrangement, an analog voltage of 1-5 Vdc corresponding to an associated pressure of 0-300 psi or 0-600 psi will be presented to JP9 Pin 3 of the CPU board of the controller 404.

In one example, the pressure transducer 402 may be included within an enclosure for the pump controller 404. In other examples, the pressure transducer 402 is mounted outside the enclosure for the pump controller and is operationally coupled to the pump controller 404.

The pressure transducer 402 is operationally coupled to the pump controller 404. The pump controller is configured to activate the motor 410 of a pump to pump water through the water system. The pump controller 404 may energize the contactor coupled directly to the motor 410 so as to cycle the pump on and off and thereby pump water through the fire protection system. This allows the controller to maintain a predetermined pressure in the water system and thereby prevent the undesired operation of a larger fire pump within the overall fire pump installation system, such as the fire pump installation system illustrated in FIG. 1. In example embodiments, the pump controller 404 is a jockey pump controller, and the motor 410 operates at least one jockey pump in a fire protection system, such as the jockey pump 106 illustrated in FIG. 1.

The single-phase control transformer 408 provides low voltage power to the control components of the pump controller 404. As illustrated, the transformer 406 is coupled to each line of the three-phase incoming line 408 on the load side of the motor protector, and this incoming line may be a 200-600 Vac 50/60 Hz line, and the transformer 406 converts the line voltage to about a 24 Vac control voltage for use by the pump controller 404, for example. The three-phase incoming line 408 further powers the motor 410 of the pump, which may utilize the full line voltage for starting. Full voltage can be applied to the motor 410 as soon as the pump controller 404 is actuated.

Alternatively, the motor 410 can be started on the wye connection that applies approximately 58% of full line voltage to the motor 410. At the reduced voltage, the motor 410 develops approximately 33% of normal starting torque and may draw approximately 33% of normal starting current. After a time delay (e.g., approximately 3.5 seconds), the motor 410 can be reconnected in delta, applying full voltage to the motor 410, for example.

The pump controller 404 may comprise an electronic circuit board 412, and optionally, an input/output (I/O) expansion board 414. The electronic circuit board 412 and/or the input/output (I/O) expansion board 414 may be a microprocessor, or functions of the electronic circuit board 412 and/or the input/output (I/O) expansion board 414 may be performed by a microprocessor, for example. The pump controller 404 can also include at least one visual indicator for displaying the pressure set points, for example. In one preferred arrangement, this pump controller 404 comprises a display module that is user accessible through a front door of a controller enclosure.

Depending on a desired configuration of the water system, the electronic circuit board 412 and/or the I/O expansion board 414 can be or include any type of processor including but not limited to a microprocessor (μP), a microcontroller (μC), a digital signal processor (DSP), or any combination thereof. The electronic circuit board 412 and/or the I/O expansion board 414 can include one or more levels of caching, a processor core, and registers. The processor core can include an arithmetic logic unit (ALU), a floating point unit (FPU), a digital signal processing core (DSP Core), or any combination thereof. Preferably, the processor comprises a TMS470-based CPU PCB.

The circuit board 412 receives an electronic signal from the pressure transducer 402 indicating a pressure value, and compares the pressure value to a set point for starting or stopping the motor 410 and/or the jockey pump. The circuit board 412 may output a pump run signal to the I/O expansion board 414, or alternatively, may output a pump run signal to energize the motor contactor coupled directly to the motor 410.

Importantly, the circuit board 412 may also receive inputs from a digital communication interface 426. As just one example, the circuit board 412 may receive inputs from a Modbus, a controller area network bus (CAN bus), or some other serial communications interface drivers 426. Other communicating interface drivers may also be provided for communication with Modbus, Modbus Ethernet, CAN, CANOpen, wireless Ethernet, DeviceNet, ProfiBus, BACNet, ARCNet, ZigBee, Bluetooth, and other similar protocol structures. Where the optional I/O expansion board 414 is provided, the circuit board 412 may be coupled to the I/O expansion board 414 through a ribbon cable 415, for example.

The microprocessor based circuit board 412 may include or have functions of a micro-processor 416, a memory 420, such as for example, volatile memory (such as RAM), non-volatile memory (such as ROM, flash memory, etc.), any combination thereof, or any type of related computer storage media. The circuit board 412 may further include a graphics display driver 422. This display driver 422 may be utilized to drive a display of the pump controller or to drive an external display such as for a PC, laptop, video monitor, television or other similar monitoring device. Such monitoring devices may be provided locally at a location of the controller (e.g., within a fire pump control room) or may be provided remotely (e.g., at a remote monitoring station).

The circuit board 412 may further include a relay output 424 to operate pump run motor contactor (24 Vac). The circuit board 412 may further include a digital interface configured to provide outputs, such as a pump running signal (24 Vac contacts) and remote alarm signals such as fail to start, motor overload, phase failure, phase reversal, and common alarm (24 Vac contacts) to the I/O expansion board 414 or to a display, for example.

The circuit board 412 may further include an analog input interface 428 configured to receive the analog signal (e.g., 1-5 Vdc) from the pressure transducer 402 to enable the circuit board 412 to compare the pressure value to a set point for starting or stopping the motor 410, for example. The circuit board 412 may further include a keypad interface 430 configured to receive inputs from a graphical user interface (GUI), and a switching power supply 432 (e.g., 24 Vac input). Any of the functions or components of the circuit board 412 may be combined as well.

The memory 420 may include stored software applications, and the micro-processor 416 may be configured to access the memory 420 and execute one or more of the software applications stored therein. The software applications may include processes for receiving a pressure signal, comparing the pressure signal to at least one set point value, and based on the comparison to make a determination whether to start and/or stop the motor 410. The software applications may further include processes as described below in the flowchart of FIG. 6, for example.

The memory 420 may further be configured to store historical events and/or real time operational conditions of the system 400. For example, such data maintained for the system 400 could include such operational information such as the operational conditions that may occur to initiate or end operation of the motor 410. The details may include pressure values received from the pressure transducer 402, start and stop times of the motor 410, run-times of the motor 410, alarms and on any of the lines of the three-phase incoming line 408, for example. Any of the data may further include date time-stamps to indicate a time the data was collected. In other examples, the memory 420 may be configured to store a data log of actions or events of the system 400 noting each event that occurs and other related operating conditions related to an event. Preferably, the data log may comprise a historical account of cycling actions of the system 400, in particular, the cycling actions of the jockey pump. Alternatively, the data log may comprise a historical account of cycling actions of the system 400, in particular, the cycling actions of the fire pump as well as the jockey pump. In one another alternative configuration, the data log may comprise a historical account of the various cycling actions within the two or more maintenance pumps that may be included within the pumping system. As just one example, the data log may comprise a historical account of the various cycling actions within the two or more jockey pumps that may be included within a fire pumping system.

Because of its programmability, the microprocessor based controller 404 may be programmed to operate in a plurality of different operating modes. For example, as illustrated, the controller 404 may comprise a Manual-Off-Auto (M-O-A) input module 401. This module may comprises a hardwire module comprising hard wired M-O-A three position switch. Alternately, this Manual-Off-Auto (M-O-A) input module may comprise a circuit component of a soft touch operator key pad mounted to a door of the controller enclosure.

As such, a first mode of operation of the pump controller may comprise the OFF Mode. In this mode of operation, the M-O-A switch would reside in an OFF position. In this mode of operation, the controller 404 would inhibit or halt all control operations of the motor 410, and hence the pump operationally coupled to the motor 410. Importantly, a Program Update Mode for the controller 404 may also provided by the controller. The OFF Mode may also be configured so that the controller 404 is permitted to receive upgrades of controller firmware during a Program Update Mode. Preferably, during this Program Update Mode, the controller 404 is inhibited from pump operations.

In the Automatic Mode, the M-O-A switch will reside in an Automatic position. In this position, the M-O-A switch places the controller 404 under an automatic pressure control. In such a control mode, the controller 404 will cycle the pump on and off preferably between a programmable START pressure set point and a STOP pressure set point. The programmable START and STOP set points are ordinarily set well above those set points of the fire pump START and STOP settings. As such, the controller 404 may be operated such that the jockey pump is cycled to maintain pressure against normal system leakage and thereby prevents the fire pump from nuisance starting.

During this cycling operation while in the Automatic Mode of operation, the jockey controller 404 can provide a feature of recording certain data points under a variety of operating conditions. As just one example, during pump controller operation, pressure recordings may be provided at certain programmable times, such as at every 15 seconds. Additionally, event recordings can include the current pressure reading along with a date time stamp so that a specific pressure that occurs at a specific time may be recorded, stored and then later monitored or analyzed. In addition, the controller can be configured to record pressure when an excursion beyond a predefined pressure deviation, referred to as ΔP, has been measured. For example, the controller 404 can be programmed so that it determines that the monitored pressure is greater than 10 psi over a certain threshold pressure value. Therefore, whenever the absolute value of the difference between the present and last recorded pressure is greater than a certain predetermined differential pressure value ΔP (e.g., such as 10 psi), the new value of pressure is logged and recorded with a date timestamp, and is stored as the last recorded value. The ΔP value is applied then in this manner to all monitored pressure readings going forward in time.

If the controller 404 is in the Manual Mode of operation, as illustrated in FIG. 4, the M-O-A switch will reside in the Manual position. In Manual Mode, the controller 404 will start and stop the motor 410 directly from the M-O-A module 401.

Preferably, the controller 404 may comprise a control sequence that may be implemented by way of a software-based state machine. In one preferred state machine arrangement, the state machine comprises at least three states: an Idle, a Starting State, and a Running State. For example, in the Idle State, the motor will not be energized and hence the pump will not be running. However, in one preferred operational arrangement, the state machine monitors various discrete and measured data points to determine whether conditions exist to advance the controller 404 to a subsequent State, such as the Starting State.

During the Starting State, the control logic of the microprocessor enabled controller 404 will account for timers and/or configuration options that might be intended to delay or inhibit a state transition.

The Starting State contains the logic associated with the proper start up of the maintenance pump. A successful detection of an active pump may cause the state to transition to the Running State. Failure to start the pump or pumps will likewise be detected and may result in certain alarm indications. As just one example, a failure to start alarm may be declared if a 24 Vac signal is not received from an auxiliary contact M 407 within a certain predetermined time frame (e.g., within 1 second of energizing 1 CR).

In the Running State, the pump will be active. During the Running State, the state machine can monitor various discrete and measured data points to determine whether conditions exists to stop the pump and, as such, advance the control to an Idle State. During the Running State, the microprocessor based logic will also account for any timers or configuration options intended to delay or inhibit a state transition of the pump.

The controller 404 may also comprise a plurality of programmable timers. In one controller arrangement, two types of programmable timers may be provided: Control Sequence Timers and Elapsed Timers. Preferably, the control sequence timers may interact with the pump control state machine and may comprise either an On Delay Timer or a Minimum Run Timer. The On Delay Timer provides a type of sincerity test for system pressure in the AUTO Mode. That is, this On Delay Timer can be used to guard against nuisance activations of the pump due to pressure excursions such as water hammer. The Minimum Run Timer may be used to specify a minimum length of time the pump is kept running in the AUTO mode to prevent short-cycling of the pump. Certain aspects of this AUTO mode of controller operation was previously described. In this AUTO mode, the controller can be programmed so that it can keep the pump running until the minimum run timer has expired provided a STOP pressure within the pump system has been reached (pressure satisfied).

The Elapsed and/or Service Timers are used for data and event logging purposes. For example, such Timers may comprise one or more of the following:

| | |
|---|---|
| Last Pump Run Timer | Records the duration of the most recent pump operation. This timer may be initiated when the pump is started and terminated when the pump is stopped. |
| Total Pump Run Timer | Records the cumulative duration of all pump running operations. |
| Total Unit Run Timer | Records the cumulative duration of time that the controller has been operations. |
| Pressure Recording Timer | Manages the interval for logging measured pressure. |
| Service Message Timer | Counts the weeks for scheduling the posting of a message that service is due. |

The I/O expansion board 414 may be coupled to the circuit board 412 and may receive signals from the circuit board 412. The I/O expansion board 414 may also receive user input signals, and inputs from the three-phase incoming line 408 to monitor the phases (e.g., phase L1 input (200-600 Vac), phase L2 input (200-600 Vac), and phase L3 input (200-600 Vac)). The I/O Expansion Board converts the incoming three-phase sinusoidal waveforms to digital square waves which are output to circuit board 412 for phase failure and phase reversal detection.

The I/O expansion board 414 may include mappable alarm relays for a fail-to-start relay 430, phase failure alarm relay and phase reversal alarm relay 440, and also for a motor overload relay 435, a switch mis-set alarm relay, an auto mode relay, a manual mode relay, an off mode relay, a common alarm relay 445, and an audible alarm relay, for example. Such relays may be operated by the I/O expansion board 414 to perform functions of the relays, or alternatively, may operate and provide output signals to the circuit board 412. The relays may be or include any type of switch or electrically operated switch, for example.

In some examples, the I/O expansion board 414 is configured to provide additional processing capabilities for the circuit board 412, such as to receive additional inputs. The I/O expansion board 414 may further be configured to output two or more pump run signals for operating two or more motors 410 on the three-phase incoming line 408, such as by initializing the three-phase incoming line 408 to provide power to motors 410 in duplex and triplex multiple pumping systems. The I/O expansion board 414 may be configured to instruct the one or two pump motors 410 to continue to run until the I/O expansion board receives a signal from the electronic circuit board 412 indicating that the pressure value is satisfied (above the set point) and a minimum run timer has expired, whichever occurs last, for example.

In yet another alternative arrangement, the I/O expansion board 414 may comprise one or more programmable auxiliary analog channels for tank level control applications. Alternatively, these auxiliary analog channels may be used in pumping applications comprising duplex or triplex Tank Fill and Discharge Pumping Systems. These analog channels may be configured for either 15 Vdc or 4-20 mA operation.

The pump controller 404 enables control of the jockey pump through control of the motor 410. The pump controller 404 may instruct the motor 410 (and the pump) to continue to run until a pressure in the system returns to a normal level and a minimum run timer has expired, whichever occurs last, for example. Operation of the pump for a minimum run time using a run timer or delay may prevent the jockey pump from being started too frequently (short-cycling). An On-delay timer is provided to prevent unnecessary starting of the jockey pump in case of erratic pressure fluctuations.

Figure 5:
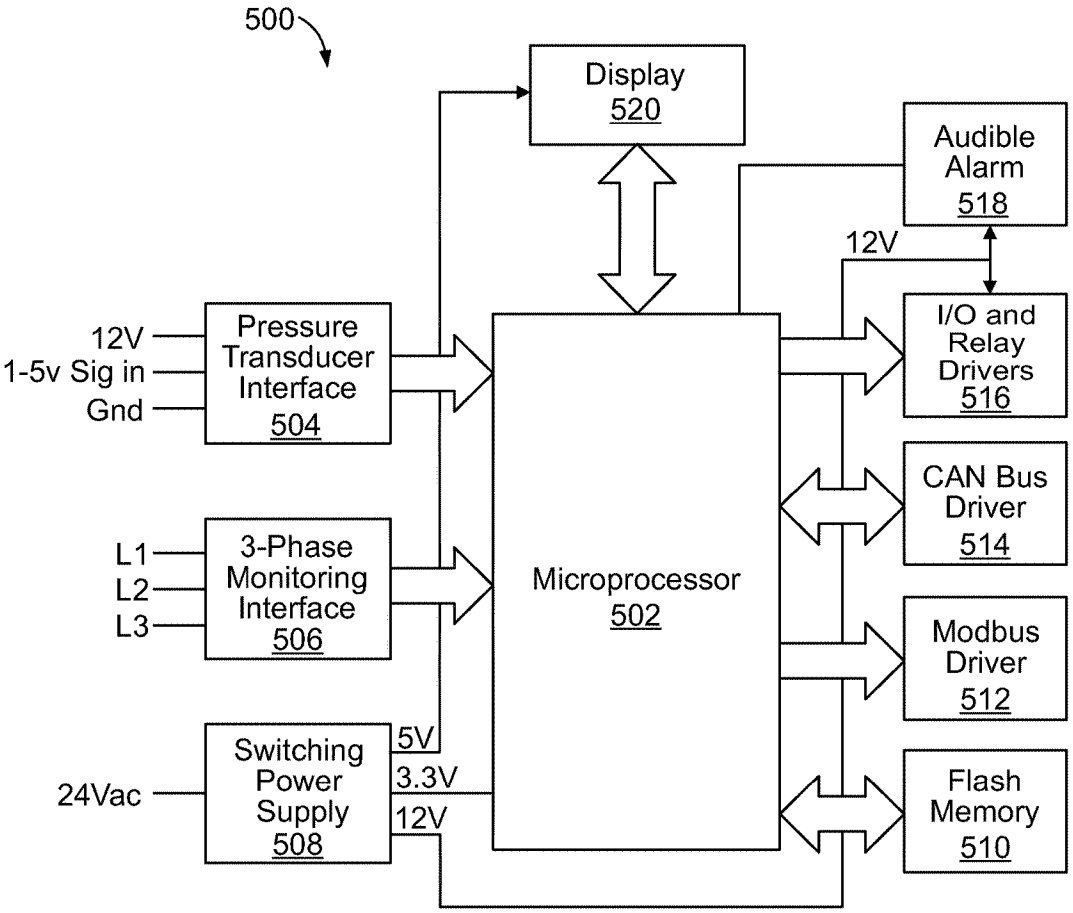
FIG. 5 is a block diagram illustrating another example of a pump controller system configured to control a jockey pump to maintain water pressure within a water system.

FIG. 5 is a block diagram illustrating another embodiment of a pump controller system 500 configured to control a jockey pump to maintain water pressure within a water system. In some examples, the system 500 may include one or more functional or physical components such as a microprocessor 502, a pressure transducer interface 504, a 3-phase monitoring interface 506, a switching power supply 508, a flash memory 510, a Modbus driver 512, a CAN bus driver 514, I/O and relay drivers 516, an audible alarm 518, and a display 520. One or more of the described functions or physical components may be divided up into additional functional or physical components, or combined into fewer functional or physical components. In some further examples, additional functional and/or physical components may be added to the examples illustrated by FIG. 5.

The microprocessor 502 may be any type of processor including but not limited to a microprocessor (μP), a microcontroller (μC), a digital signal processor (DSP), or any combination thereof. In some examples, the microprocessor 502 or functions of the microprocessor 502 may be provided by multiple processors.

The microprocessor 502 receives an analog input signal from the pressure transducer interface 504 that can be interpreted as indicating a value of a pressure in a water system. The signal may be between 1V to 5V for 0-300 psi and 0-600 psi. In one example, the microprocessor 502 interprets the signal to indicate a value of a pressure.

The system may further comprise a phase monitoring interface, such as a 3-phase monitoring interface 506. This phase monitoring interface could be part of the I/O expansion board, part of the CUP processor board, or alternatively could be a separate component from the two. For example, the microprocessor 502 may receive inputs from the 3-phase monitoring interface 506, which can monitor a 3-phase power line (e.g., L1, L2, and L3) for detection of phase failure and phase reversal. As just one example, the I/O expansion board may provide half-wave rectification of the three incoming phases and converts them to digital square wave signals for input to the controller. These digital square wave signals may be indicative of a power line characteristic such as supply voltage, voltage phase, and voltage frequency. For example, based in part on such digital square wave signals, the controller could determines whether there is a valid supply line with all three phases present, a correct phase rotation, and proper frequency.

The microprocessor 502 may be powered by the switching power supply 508 that is configured to receive 24 Vac and output appropriate voltage values to power components of the pump controller 500, such as 5V, 3.3V, and 1V, for example.

The microprocessor 502 may communicate with the flash memory 510 (or other memory) to store operating conditions of the system 500, such as history codes or occurrences of operation of the pump controller system 500, for example. The microprocessor 502 further may output to a Modbus driver 512 and communicate with the CAN bus driver 514 for serial network communications, for example. Serial network communications may take place, for example, with a fire pump controller or a local or remote PC.

The microprocessor 502 may further output to the I/O and relay drivers 516 to provide signals for operating the drivers for actuating the relays. The microprocessor 502 can also output to an audible alarm 518, which can generate an audible alarm when certain conditions arise.

The microprocessor 502 may further output to the display 520 to provide a visual indication of operation of the pump controller system 500, for example.

Figure 6:
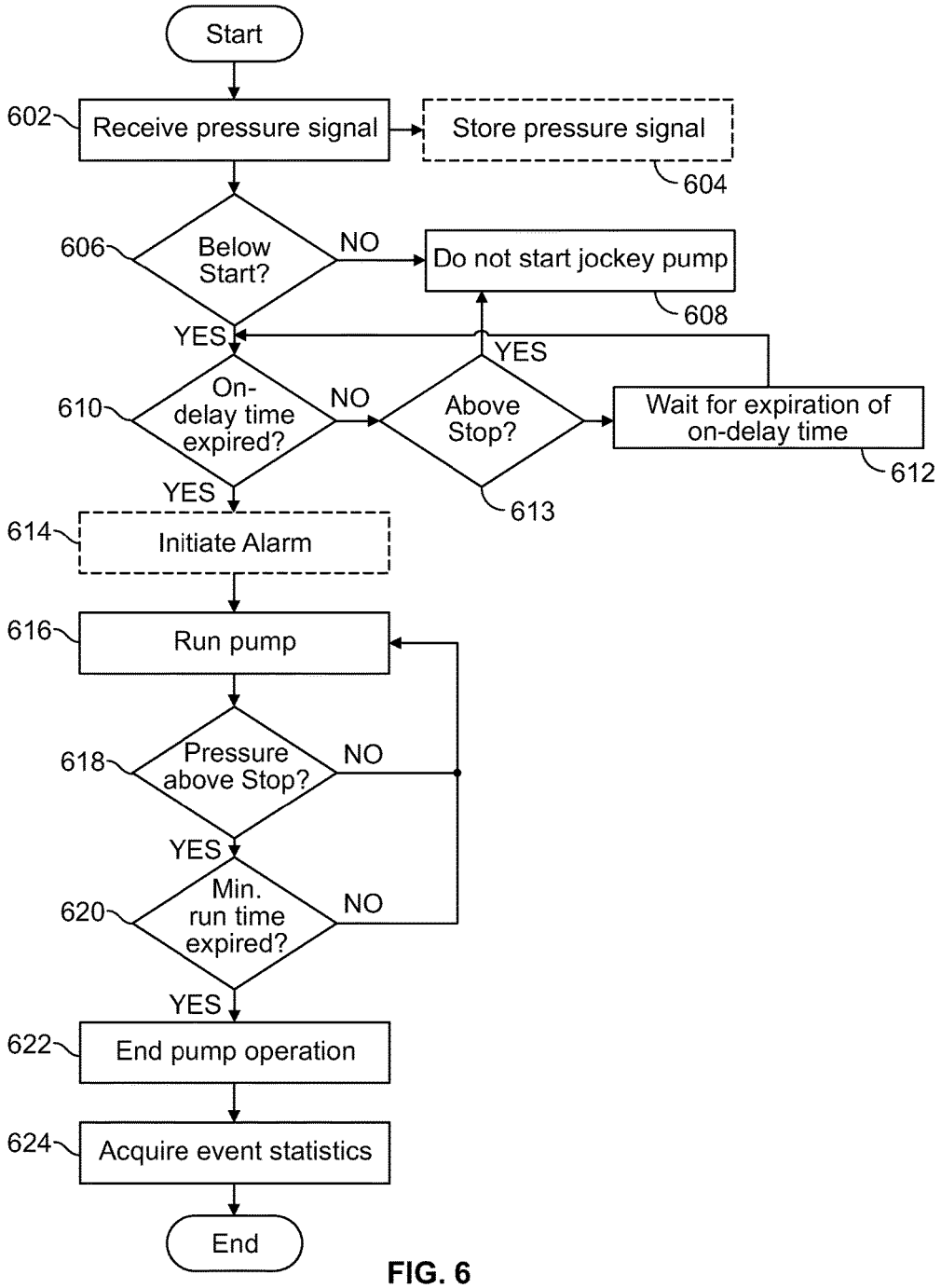
FIG. 6 shows a flowchart of an illustrative embodiment of a method for operating a jockey pump controller.

FIG. 6 shows a flowchart of an illustrative embodiment of a method 600 of jockey pump controller operation and data logging such operation. It should be understood that for this and other processes and methods disclosed herein, the flowchart shows functionality and operation of one possible implementation of present embodiments, such as the micro-controller 404 illustrated in FIG. 4. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In addition, each block in FIG. 6 may represent circuitry that is wired to perform the specific logical functions in the process. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

Initially, as shown at block 602, a pressure signal is received. For example, a jockey pump controller may receive a pressure signal that indicates a magnitude of water pressure within a fire protection system, such as the system illustrated in FIG. 1. The pressure signal may indicate the pressure of water within a water line that couples to a fire pump. The pressure signal may indicate the magnitude, or alternatively, may indicate that the pressure is above or below the set points, for example.

The jockey pump controller may include memory, and thus, the method may optionally include the jockey pump controller storing the pressure signal, as shown at block 604. Aside from the pressure signal, the jockey pump controller may also store other data associated with this pressure signal such as the date and time the pressure signal was received, line voltage data at the time such data was received, the mode of jockey pump operation at the time such data was received, the mode of fire pump and/or fire pump controller operation at the time such data was received, as well as other related data. As those of skill in the art will recognize, other fire pumping system data could also be identified, characterized and stored as well.

Next, the jockey pump controller determines if the pressure is below a predetermined or pre-programmed set point, as shown at block 606. If the pressure is not below a set point, the controller will determine that the pressure in the water line is at an acceptable level and that the jockey pump will not be started, as shown at block 608. An example threshold level may be between 0-600 psi. However, a typical setting may be 155 psi in a 175 psi rated piping system.

The jockey pump controller may be configured to start and stop the jockey pump based on pressure settings with 1 psi differential, for example. A higher or lower resolution of pressure settings can also be programmed.

When the pressure signal indicates a pressure below the threshold level, the jockey pump controller next determines if an on-delay time has expired, as shown at block 610. For example, the jockey pump controller may be programmed to initialize the jockey pump prior to running the pump coupled to the water line. Alternatively, the jockey pump controller may be programmed to wait a predetermined time before starting the pump as a low pressure sincerity check in case of erratic changes or fluctuations (the on-delay timer is reset if pressure returns above the stop set point). Therefore, an on-delay timer may be initiated upon an indication that the pressure signal is below a set point. Exemplary on-delay times may range from approximately 0-60 seconds with a typical setting being on the order of 5 seconds.

If pressure goes above STOP setting during on-delay 613, on delay is cancelled. However, after expiration of the on-delay time and if the pressure is not above STOP setting, as shown at block 612, the method may optionally include a step of initiating an alarm. This step is shown at block 614. Any number of alarms or alarm messages may be provided, such as for example, a pump running alarm, run timer on, low voltage, high voltage, voltage imbalance, motor overload, failure to start, low line frequency, high line frequency, communications failure on power monitor, communications failure on pressure monitor, and other operational related alarms. An alarm condition may cause an alarm message to be displayed by the jockey pump controller, and/or activation of an audible alarm. In the event of multiple alarms, alarm messages may scroll on a display of the jockey pump controller. Additional or alternative alarms can be provided including a phase failure alarm relay, a phase reversal alarm relay, fail-to-start alarm relay, motor overload alarm relay, or switch mis-set alarm relay, for example.

The jockey pump controller may run the pump, as shown at block 616, after expiration of the on-delay time, if provided. Operation of the pump through its check valve 121 will tend to increase the pressure of water in the main water line. The jockey pump controller may receive additional signals indicating a new pressure of the water line, and once the pressure is above the set point and if a minimum run-time has expired, pump operation is ended, as shown by blocks 618, 620, and 622. The pump may have a minimum run time so that the pump is run for a minimum amount of time to prevent short-cycling of operation of the pump, for example. The minimum run time may also prevent too frequent automatic starting of the jockey pump motor, and may be set to keep the jockey pump in operation for at least one minute, for example. Minimum run times, and on-delay times, may alternatively be removed from the method in other examples.

Exemplary pressure threshold level (or range of pressures) at which the jockey pump may be turned off may be approximately 0-600 psi where a typical setting might be approximately 175 psi in a 175 psi rated piping system.

Exemplary minimum run time ranges may be on the order of approximately 0-180 seconds with a typical setting being on the order of approximately 10 seconds.

The jockey pump controller may be further be configured to initiate or run the pump in instances in which the pressure signal is below a set point for a specified or predetermined amount of time. For example, the jockey pump controller may receive a pressure signal (as shown at block 602) every minute, on a continuous basis, or at predetermined intervals, and once the pressure is below the threshold for the specified amount of time, the jockey pump controller may then initiate operation of the pump. The jockey pump controller can access stored pressure signals so as to determine a length of time for which the pressure is below a set point. Such operation data regarding pump cycling history can be stored in the controller memory and may be accessible for later analysis and review.

In addition, the jockey pump controller may be further configured to end pump operation in instances in which the pressure signal is above a set point for a specified or predetermined amount of time. For example, the jockey pump controller may receive a pressure signal (as shown at block 602) every minute, on a continuous basis, or at predetermined intervals. Once the controller determines that the pressure is above the threshold for the specified amount of time (which may include an instantaneous amount of time), the jockey pump controller may then end operation of the pump.

Figure 2:
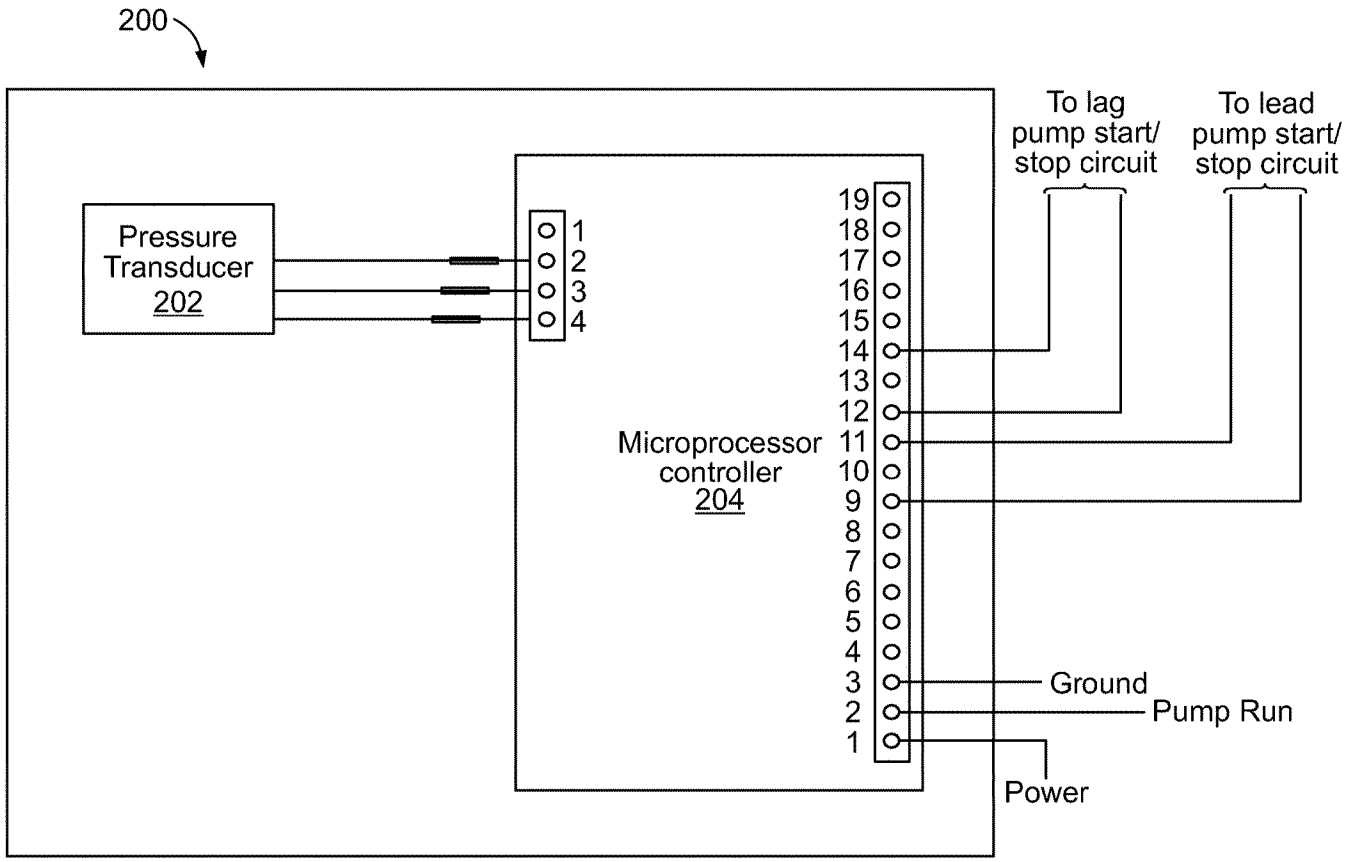
FIG. 2 Prior Art
FIG. 2 illustrates a prior art microprocessor based duplex jockey pump controller.
Figure 3:
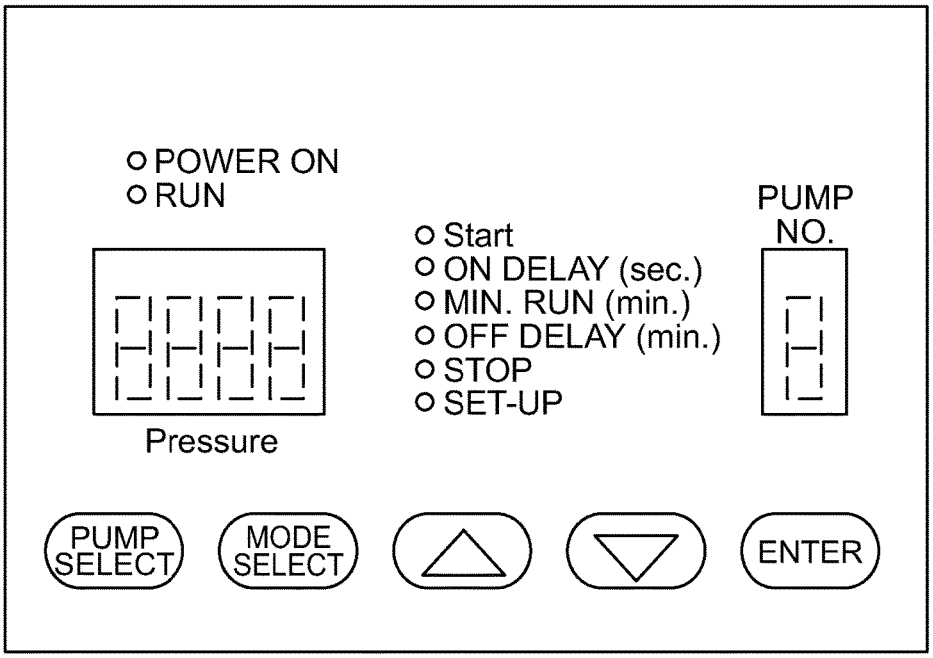
FIG. 3 Prior Art
FIG. 3 is an illustration of the prior art digital panel display that may be used along with the microprocessor jockey pump controller illustrated in FIG. 2.

One advantage of Applicants' proposed jockey pump controller, unlike the prior art controller illustrated and described with respect to FIGS. 2 and 3, is that it can be configured to acquire event statistics, as shown at block 624. The event statistics may indicate pump system details of the system before, during, and/or after operation of the jockey pump. Indeed, such pump controller may be configured to acquire such even statistics even if the jockey pump has not been operated. For example, event statistics may include recent historical events, such as an indication of when the jockey pump was operated, a run-time of the jockey pump (e.g., length of duration), a run time of the fire pump, etc. Event statistics may further include an indication for why the pressure level in the water main fell below the set point level. For example, the jockey pump controller may receive additional signals from other sensors in the system indicating that a sprinkler was triggered, a leak was present, or a valve was opened, for example, resulting in a low pressure condition in the water main that triggered operation of the jockey pump. Additional event statistics/historical codes may also include alarms as well.

Although illustrated as block 624, the jockey pump controller may also acquire event statistics of any details of the system at any time during the method of FIG. 6. For example, pressure signal information is acquired initially (as shown at block 602), and at that time, any of the details described above may also be acquired. Further, when acquiring event statistics, time stamps may be associated with the acquired data to log the event statistics in a historical data log.

Therefore, the jockey pump controller may be configured to have data acquisition capability, and preferably provides a historical data log stored or accessed via a RS-485 data port, for example. In addition, the jockey pump controller may include a printer or other recorder, and operational and alarm events, including system pressure, may be recorded on the printer, for example. The printer/recorder may be configured in a standby-run dual mode operation. In standby, the printer prints a time-stamped system pressure every 30 minutes, for example, and any alarm condition as occurred. In the run mode, the recorder prints a time-stamped call-to-run event followed by system pressure in 15 second intervals and alarm events as occurred. Information may also be stored in memory. Additional information may be recorded and logged, such as RMS motor voltage and current, horsepower and voltage of the motor, other time-stamped voltage, current, phase, frequency and alarm data for field access. In addition, the jockey pump controller may further be configured to analyze the event statistics.

Figure 7A:
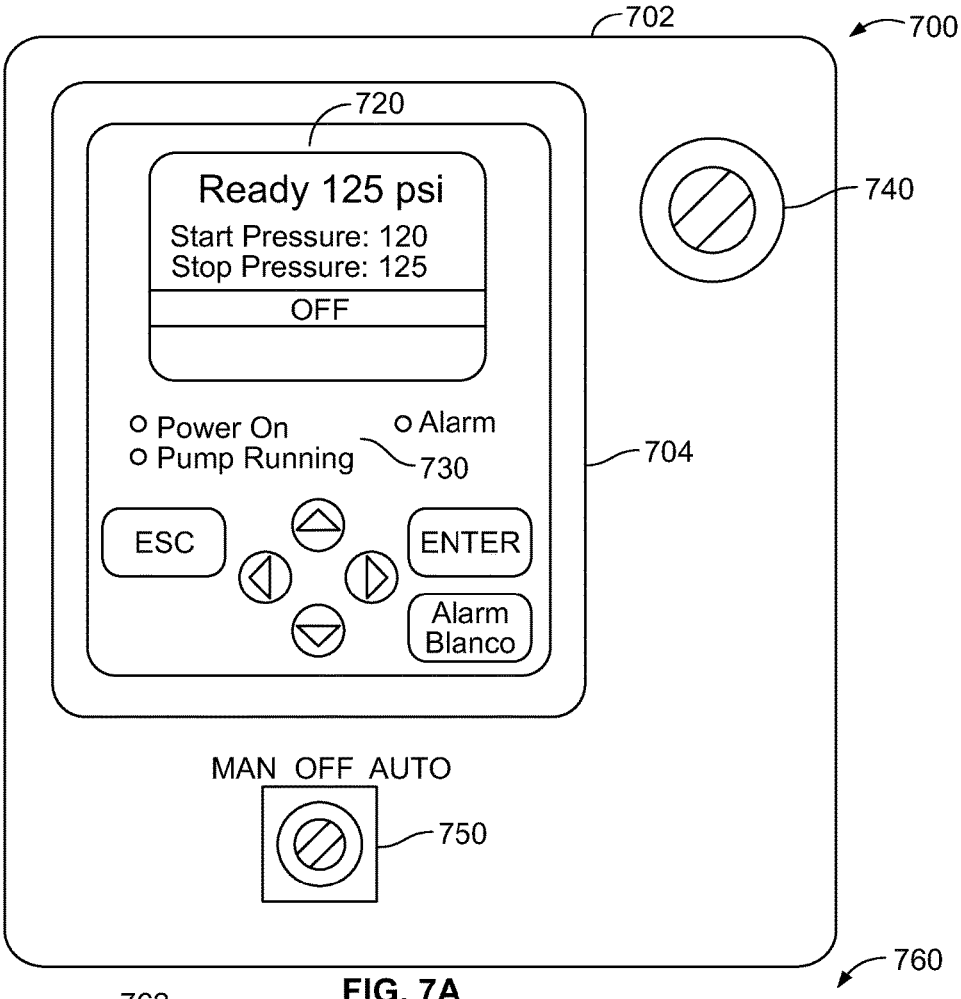
FIG. 7A illustrates an example jockey pump controller with electronic controls and a motor power train housed in an enclosure.

FIG. 7A illustrates an example jockey pump controller 700 with electronic controls and a motor power train housed in an enclosure 702, such as a fibreglass enclosure for example. The enclosure 702 may include electronic controls such as a digital pressure transducer and a graphical user interface (GUI) operated by a CPU board, for example.

An I/O Expansion Board board may also be coupled to the CPU board to provide additional features, such as phase monitoring and remote alarm contacts, for example.

The enclosure 702 may be but not limited to about 12-24 inches in width by about 15-18 inches in height. The motor power train may include a manual motor protector coupled to a motor contactor that is controlled by the CPU board, for example. The motor power train may have a short-circuit rating of about 18 kA-200 kA @ 480 Vac, and horsepower (HP) ratings of about ½-7.5 @ 240V, ½-15 @ 480V, ½-20 @ 600V, 20 HP and above @ 480V, and/or 10 HP and above @ 240V, for example.

A user interface 704 can be mounted on a door of the enclosure 702. Preferably, this user interface 704 may be visible to an operator through a sealed window, for example. A door interlocked disconnect 740 and a hardwired M-O-A switch 750 may also be provided.

As illustrated, this exemplary user interface 704 comprises a multiple key user keypad 710, a display 720, and a plurality of LEDs 730. For example, the user interface 704 may comprises seven key user soft touch operator devices for screen navigation and parameter configuration. As illustrated, these seven soft touch operator pads comprise an up key, a down key, a left key, a right key, a ESC (escape) key, an ENT (enter) key and an Alarm/Silence key.

As illustrated, the keypad 704 further comprises a display 720. Such a display may be used to display certain screens during navigation and may also be used to display certain parameter configuration data. Preferably, this display comprises a 128×64 monochrome dot matrix display. The display preferably comprises user adjustable LED backlighting. The three LEDS 730 provided by the interface may be used to indicate: Power On, Alarm, and Pump Running.

In one preferred arrangement, assembly of the interface 704 may be constructed so as to pivot away from the door of the enclosure 702 so that the interface 704 is visible with the enclosure door in an open position, for example. This provides an advantage of monitoring the operation or historical data of the jockey pump while the enclosure door is either closed or open and without having to remove power from the controller or stop operation of the system.

In one arrangement, the display 704 may have a two line, digital display plus LED indicators for controller operating and alarm functions (e.g., such as power on, pump running, and alarm), for example.

In a standby mode, the display 720 of the user interface 704 shows system pressure (in psi, for example), and optionally time and date in universal coordinated time (UTC), which allows for event recording against an international standard, for example. The display 720 may be configured to also show local time and data, simultaneous RMS voltage and current for each phase, frequency, and minimum and maximum measurement of voltage, current, frequency and pressure, for example. In a run mode, the display 704 may display an elapsed timer indicating an amount of time that the pump has been operating, for example.

The display 720 may display additional fire pump system information, such as, for example, historical data and events. The display 720 may further display a graphical user interface (GUI) to enable a user to access controls or stored information of the jockey pump controller 700.

As just one example, FIG. 8 illustrates one type of graphical user interface 760 that may be operated by a microprocessor, such as the microprocessor contained on the CPU board illustrated in FIG. 4. The GUI includes a home screen, such as the home screen illustrated in FIG. 8. As illustrated, this home screen 760 may comprise seven lines of pump system information that can be monitored so as to view the operation and historical data. For example, the first two items of the home screen 762, 764 may be used to monitor the control status of the controller and the current pressure of the system being monitored. The third and fourth lines 766, 768 of the home screen 760 may comprise user defined or preselected information. Such user defined or selectable data that could be displayed could include, but is not limited to start pressure, stop pressure, total pump run time (e.g., determined by way of an elapsed timer), number of pump cycles, number of pump cycles per hour, number of pump cycles per day, number of pump cycles per month, or the number of pump cycles captured in a programmable pre-defined date-time interval. In addition, the home screen 760 may also be used to indicate, for example, in the fifth line 770 of the home screen, the position of manual-off-auto (M-O-A) switch position. The next line 772 may be used to monitor the active alarms and/or status indication. Line 7 may be used to monitor date and time or status of an active running timer. And the last line 776 may be used to monitor a secondary status area. For example, a secondary status area may be used to provide additional information to the user on the Control Status (e.g., addition diagnostic information in the case of a certain faults)

Figure 11:
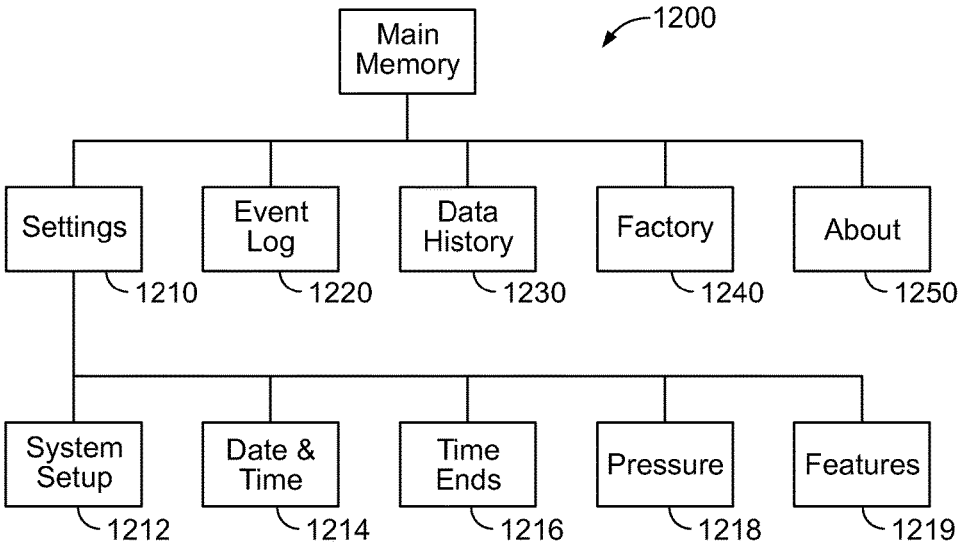
FIG. 11 illustrates an example Graphical User Interface providing navigation through the screens in the "Main Menu" for the operation of a jockey pump controller.

The GUI may also be used to access certain main menus and submenus whereby such menus may be manipulated to allow a user to program the operational control of the controller. For example, FIG. 11 illustrates one layout of a main menu 1200 for use with the GUI illustrated in FIG. 8A. For example, as illustrated in FIG. 11, the GUI may be manipulated to access a main menu 1200. Once in this main menu, certain sub-menus may be accessed. For example, in one Main Menu arrangement, five different submenus 1210, 1220, 1230, 1240, and 1250 may be accessed through the GUI.

For example, a first Settings sub-menu 1210 may be accessed. As illustrated, this sub-menu 1212 allows a user access to various other submenus including a submenu for System Setup 1212, Data and Time 1214, Timers 1216, Pressure 1218, and Features 1219. One or more of these submenus may be locked out by the manufacturer or password protected.

Figure 12:
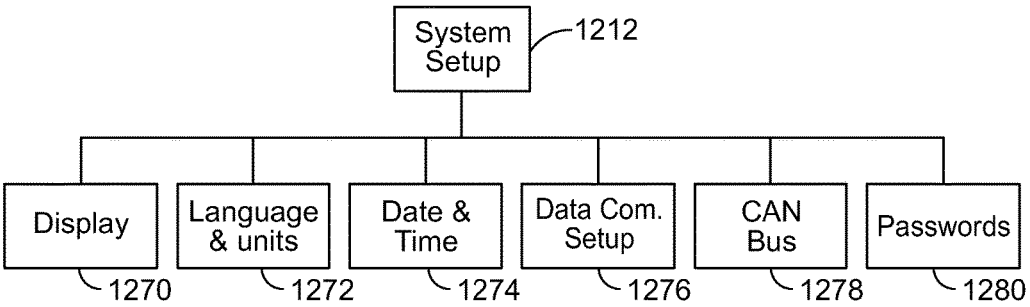
FIG. 12 illustrates the screens in the "System Setup" sub-menu of the "Main Menu" in FIG. 11.

The System Setup sub-menu 1212 of the Setting sub-menu 1210 is further illustrated in FIG. 12. As illustrated, this Settings submenu 1210 could allow access to various sub-menus including a Display menu 1270, a Language and Units menu 1272, a Date and Time submenu 1274, a Data Communications setup menu 1276, a CAN Bus menu 1278, and a Passwords menu 1280. The Display Menu 1270 could allow user access to controls for the brightness, contrast, invert or keyboard timeout features of the display. The Language and Units Sub-Menu 1272 could allow user access to the language used in the text and measuring units for the temperature and pressure settings of the controller. The Date and Time submenu 1274 could allow user access to the time, date and daylight savings settings of the controller. The Data Communications setup menu 1276 could allow user access to the port assignment, slave setup, and master setup features of the controller. The CAN Bus submenu 1278 could allow user access to the enable, address and baud setup features of the controller. And the Password menu may be used to prevent multiple levels of password protection to prevent unauthorized manipulation.

As previously discussed, the controller comprises a data storage device (e.g., non-volatile storage) for storing certain relevant operational data. For example, the controller may comprise a data storage device (e.g., a non-volatile chronologically sorted event log with a FIFO storage capacity) for storing certain event data.

Returning to FIG. 11, this operational data may be accessible by way of an Event Log submenu 1220 or a Data History submenu 1230. The event log is a FIFO list of date time stamped events (3000) containing pressure readings, starts, stops, alarms, and other occurrences. The pressure reading as the only embedded variable. Pressure events are recorded hour when the pump is not running and every 15 seconds when the pump is running. Pressure readings can also be controlled by ΔP. Data history basically consists of 1) registers accumulating numbers of calls, starts, cycles, total elapsed controller run time, total elapsed motor run time, last motor run time, etc. It also consists of some key events from the event log that are captured and stored for user convenience such as last pump start, last phase failure, last phase reversal, minimum pressure and maximum pressure. Both submenus may be accessible by way of the main menu GUI 1200. In one preferred arrangement, the Data History sub-menu 1230 allows the user to have access to certain historical data as to the operation and control of the jockey pump. Such information could include, but is not limited to data related to the following:

| | |
|---|---|
| Call to Start | A low pressure event |
| Starts | A call to start followed by a successful start of the pump. A successful start is qualified by the receipt of a "motor on" feedback signal from the auxiliary contact of the motor contactor. |
| Pump Total Run Time | Maintains a cumulative count of the total elapsed time that the controller has been in service. |
| Most Recent Run Time | Maintains the runtime duration from the most recent pup activation. |
| Controller Run Time | Increases every time the pump is automatically called to start due to a drop in pressure below the START pressure. |
| Last Pump Start | Date and time stamp of last pump start. |
| Minimum Pressure | This data set maintains the minimum pressure measured. |
| Maximum Pressure | This data set maintains the maximum pressure measured. |
| Last Phase Failure | Date and time stamp of last phase failure. |
| Last Phase Reversal | Date and time stamp of last phase reversal. |

Importantly, certain jockey pump cycle data history may also be accessed via the serial communications interface on the CPU board as well. Such jockey pump cycle data history could also include one or more of the following:

| | |
|---|---|
| Number of Cycles | Number of pump cycles run |
| Number of Cycles Per Hour | Average number of pump cycles per hour. |
| Number of Cycles Per Day | Average number of pump cycles per day. |
| Number of Cycles Per Month | Average number of pump cycles per month. |
| Number of Cycles Captured In a pre-determined time interval | User settable. |
| Reset Cycle Counter | Resets or clears register for cycle counter. |

The enclosure 702 is further shown including a manual-off-auto soft key that may be configured to operate the jockey pump or jockey pump controller, for example. The enclosure 702 may include a disconnect switch that is mechanically interlocked with the jockey pump controller 700 so that the enclosure 702 cannot be opened with the handle in the ON position except by override mechanisms, for example.

Figure 7B:
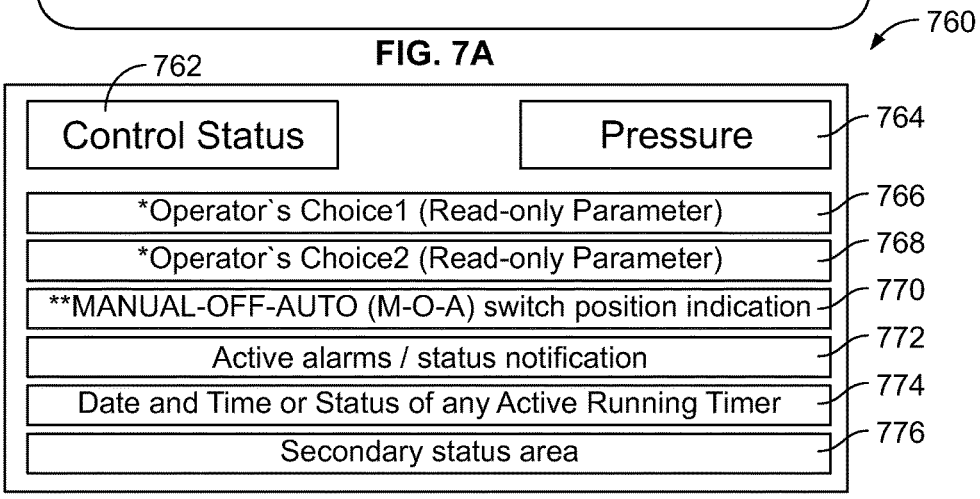
FIG. 7B illustrates an example home screen display of a jockey pump controller, such as the controller illustrated in FIG. 7A.
Figure 8B:
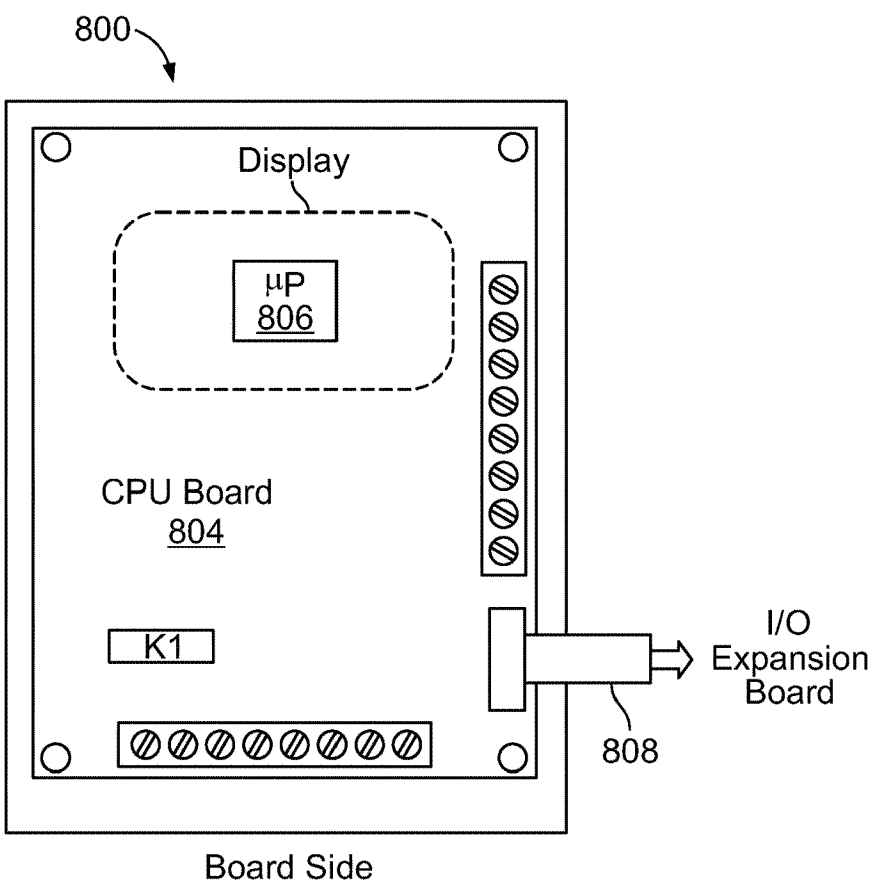
FIG. 8 illustrate an example electronic control board.
Figure 8A:
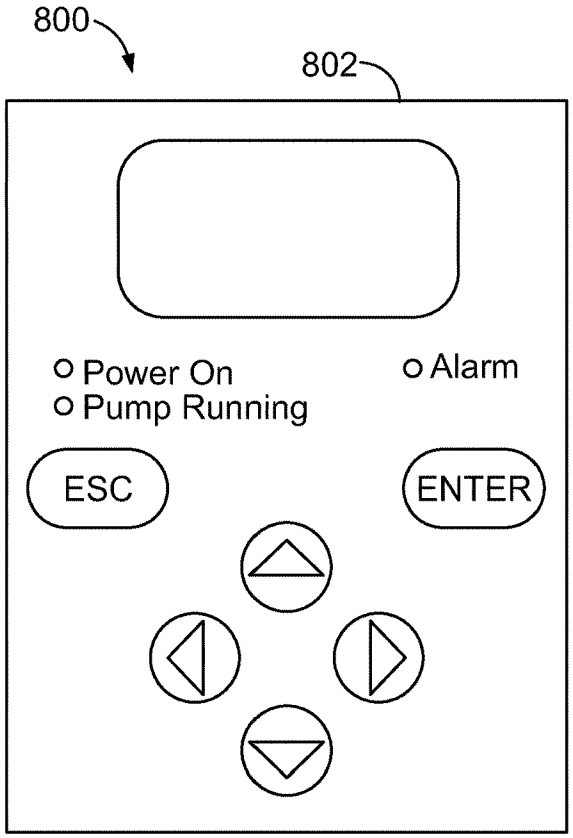

FIG. 8A-B illustrate an example electronic control board assembly 800. In FIG. 8A, a front view of the electronic control board assembly 800 is shown and includes a display 802, such as the display 704 shown in FIG. 7, for example. The display 802 is configured to provide digital display of operating conditions, time and date. The display 802 may be programmed to provide additional information. Time can be retained and displayed in UTC. The display 802 can also provide display of simultaneous RMS voltage and current for all three phases of line voltage, frequency, system pressure, minimum and maximum voltage, current, frequency and pressure, for example.

FIG. 8B illustrates an example rear view of the electronic circuit board assembly 800. A rear view of the electronic circuit board assembly 800 illustrates a view opposite the display 802. Opposite the display 802, the electronic circuit board 800 includes a CPU board 804. The CPU board 804 may be the same as or similar to the circuit board 412 of FIG. 4 or the microprocessor 502 of FIG. 5, for example. The CPU board 804 may include a microprocessor 806 and may also include a coupling 808 to an I/O expansion board (e.g., such as the I/O expansion board 414 shown in FIG. 4).

The CPU board 804 may be directly mounted on a backside of the display 802, for example. Alternatively, the CPU board 804 and the display 802 may be individually coupled to the electronic circuit board assembly 800.

Figure 9:
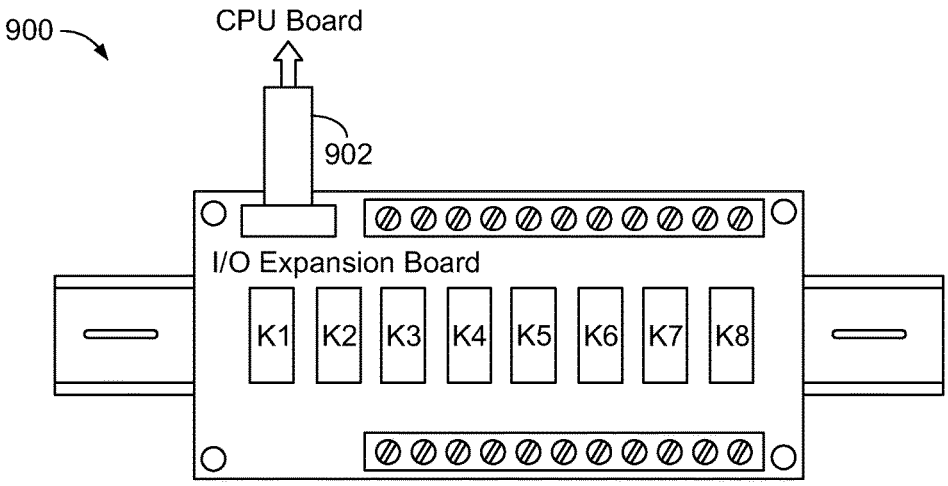
FIG. 9 illustrates an example I/O expansion board.

FIG. 9 illustrates an example block diagram of another I/O expansion board 900. The I/O expansion board 900 may be the same as or operate similar to the I/O expansion board 414 shown in FIG. 4. The I/O expansion board may be used to expand the input and output capabilities of the controller by providing a plurality of user inputs and a plurality of user outputs. In one preferred expansion board arrangement, the board will have provisions for two additional analog channels and three-phase monitoring. The I/O expansion board 900 may couple to a CPU board using a ribbon 902. As illustrated, K1 through K8 are form C relays, i.e. a common contact, a normally-open contact and a normally-closed contact. The I/O expansion board 902 may be a DIN-rail mounted I/O expansion board, for example.

Figure 10:
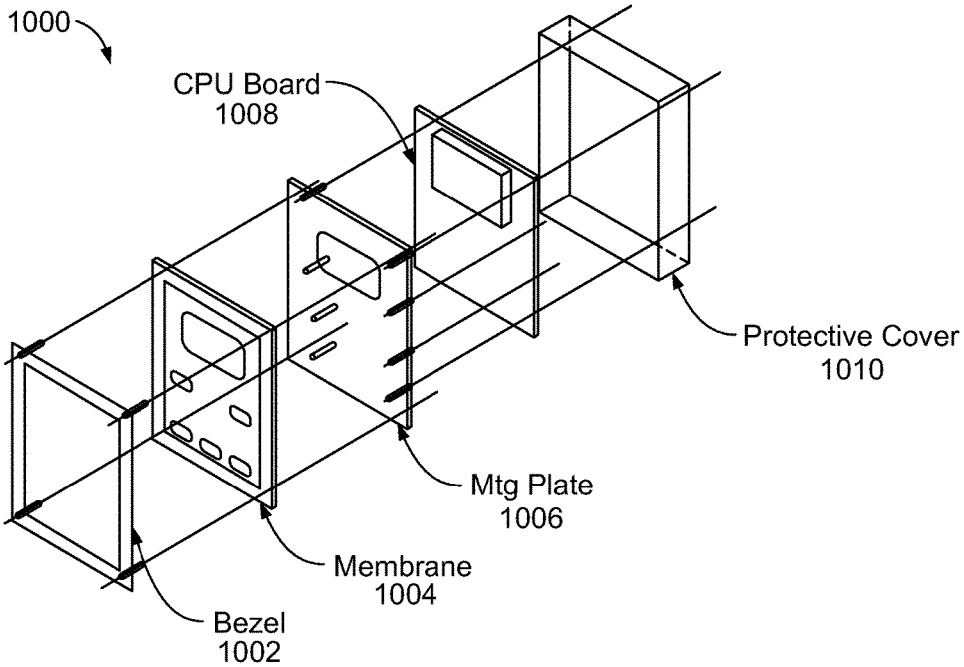
FIG. 10 is an example exploded view of an electronic circuit board assembly.

FIG. 10 is an example expanded view of an electronic circuit board 1000. The electronic circuit board assembly 1000 includes a bezel 1002 covering a membrane assembly 1004 that is configured to have openings for LED indicators and a digital display, for example. The membrane 1004 couples to a mounting plate 1006. A CPU board 1008 couples to the mounting plate 1006, and a protective cover 1010 may hold or surround the CPU board 1008, for example. The electronic circuit board assembly 1000 may be the same or similar to the electronic circuit board 800, for example, and includes a display within the membrane layer 1004 and the CPU board 1008 on an opposite side of the membrane 1004. As just one example, the soft touch user interface 704 illustrated in FIG. 7 may be provided within the membrane 1004.

By providing user access to such a soft touch user interface 704 in a sealed membrane and on the cover of the controller enclosure provides certain advantages. First, it makes a user's interaction with the controller programmability as simple, efficient, and electrically safe, as possible as access to the internal of the enclosure is not required. As such, the enclosure door need not be opened to either program operation of the controller or access internal CPU. In addition, power to the enclosure device can still be maintained during controller programming. In addition, and as described above, event history and data logging may be viewed as well. Second, by providing the user interface in a sealed door mounted membrane, such as the membrane 1004 illustrated in FIG. 10, certain overall ratings of the entire enclosure may be achieved. For example, by sealing the user interface, the overall enclosure may provide the controller to be installed in environments requiring that the enclosure be built to certain varying NEMA standards. Such standards may include NEMA 2, 3R (rain tight weatherproof), 4 (watertight), 4X (corrosion resistant coating, watertight) or 12 (dust tight, drip tight enclosure) installations where the enclosure might be susceptible to harsher environments. Therefore, as those of ordinary skill in the art will recognize, providing a maintenance pump controller in a large number of optional enclosures reduces overall installation costs since such enclosures may now be directly mounted within more difficult pump room environments rather than having to be mounted remotely from the actually maintenance pump. As such, installation costs are reduced since additional wiring and cabling and conduit installation is not required. In addition, having the controller in close proximity to the actually maintenance pump also provides certain maintenance advantages where the actual operation of the pump may be witnessed while being operated by the controller.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is also to be understood that the terminology used herein is for the purpose of describing particular embodiments only, and is not intended to be limiting.

What is claimed is:

1. A maintenance pump system in a fire pump control room, comprising:

a maintenance pump controller residing within the fire pump control room and for controlling an operation of a maintenance pump, wherein the maintenance pump controller comprises:

an electronic circuit board comprising a programmable microprocessor, the microprocessor configured to receive a signal indicating a pressure value, to compare the pressure value to a threshold for initiating operation of the maintenance pump, and to operate the maintenance pump if the pressure value is less than the threshold for initiating operation of the maintenance pump;

a memory operatively configured to the programmable microprocessor, wherein the memory stores event statistics that are representative of (i) a past operation of the maintenance pump and (ii) pump system details of the pump system before, during, and after the past operation of the maintenance pump, wherein the maintenance pump controller is configured to analyze the stored event statistics, wherein the stored event statistics comprise a cycle data history for a plurality of past cycles of the maintenance pump and, for each cycle of the past cycles of the maintenance pump, an indication of a cause of a change in the pressure value within the pump system that triggered operation of the maintenance pump, wherein additional sensors indicate the cause of the change in the pressure value, the additional sensors sensing when a sprinkler is triggered, when a leak is present or when a valve is opened;

when the maintenance pump controller determines that the pressure value is greater than a predefined pressure deviation over a last recorded pressure value, the event statistics store the pressure value with a date timestamp as the last recorded pressure value against which subsequent pressure values are compared; and a communications interface, wherein the stored event statistics are accessible through the communications interface after the past operation of the maintenance pump;

wherein the maintenance pump controller further comprises a phase monitoring interface that provides pulsed digital signals to the programmable microprocessor, the pulsed digital signals indicative of a power line characteristic, and wherein the maintenance pump controller determines, based in part on the pulsed digital signals, whether there is a valid supply line with all phases present, a correct phase rotation, and proper frequency.

2. The maintenance pump system of claim 1, wherein the electronic circuit board is configured to receive inputs from a serial communication interface.

3. The maintenance pump system of claim 1 wherein the maintenance pump controller further comprises an input/output (I/O) expansion board operatively coupled to the electronic circuit board.

4. The maintenance pump system of claim 1, wherein the electronic circuit board includes a graphics display driver, a relay output, a digital interface, an analog input interface, and a keypad interface.

5. The maintenance pump system of claim 1, wherein the maintenance pump controller is configured to instruct the maintenance pump to continue to run until it receives a signal from the electronic circuit board indicating that the pressure value is above the threshold and a minimum run timer has expired, whichever occurs last.

6. The maintenance pump system of claim 1, wherein the maintenance pump controller further comprises a pressure transducer configured to generate, based on a pressure of the pump system, the signal.

7. The maintenance pump system of claim 1, wherein the maintenance pump controller is configured to instruct the maintenance pump to run after receiving a pump run signal from the electronic circuit board and after an on-delay time has expired.

8. The maintenance pump system of claim 1, wherein the cycle data history for the plurality of past cycles of the maintenance pump includes, for each cycle of the past cycles of the maintenance pump, an indication of when the maintenance pump was operated and a run-time of the maintenance pump.

9. The maintenance pump system of claim 1, wherein the event statistics comprise a historical data log of certain operational conditions of the maintenance pump.

10. The maintenance pump system of claim 1, wherein the communications interface comprises a display, and wherein the event statistics are retrievable and viewable via the display.

11. The maintenance pump system of claim 1, wherein the maintenance pump controller further comprises an enclosure that is configured to house the electronic circuit board, wherein the enclosure further comprises a door;

and further comprising a user accessible door mounted touch screen display.

12. The maintenance pump system of claim 1 wherein the maintenance pump controller is programmed to allow the maintenance pump controller to operate at least two maintenance pumps within the pump system.

13. The maintenance pump system of claim 12 wherein the maintenance pump controller maintains the event statistics for the at least two maintenance pumps within the pump system.

14. The maintenance pump system of claim 1 further comprising a programmable timer.

15. The maintenance pump system of claim 1, wherein the phase monitoring interface is provided by an expansion board.

16. A maintenance pump system in a fire pump control room, comprising:

a maintenance pump controller residing within the fire pump control room and for controlling an operation of a maintenance pump, wherein the maintenance pump controller comprises:

an electronic circuit board comprising a programmable microprocessor, the microprocessor configured to receive a signal indicating a pressure value, to compare the pressure value to a threshold for initiating operation of the maintenance pump, and to operate the maintenance pump if the pressure value is less than the threshold for initiating operation of the maintenance pump;

a memory operatively configured to the programmable microprocessor, wherein the memory stores event statistics that are representative of (i) a past operation of the maintenance pump and (ii) pump system details of the pump system before, during, and after the past operation of the maintenance pump, wherein the maintenance pump controller is configured to analyze the stored event statistics, wherein the stored event statistics comprise a cycle data history for a plurality of past cycles of the maintenance pump and, for each cycle of the past cycles of the maintenance pump, an indication of a cause of a change in the pressure value within the pump system that triggered operation of the maintenance pump, wherein additional sensors indicate the cause of the change in the pressure value, the additional sensors sensing when a sprinkler is triggered, when a leak is present or when a valve is opened;

when the maintenance pump controller determines that the pressure value is greater than a predefined pressure deviation over a last recorded pressure value, the event statistics store the pressure value with a date timestamp as the last recorded pressure value against which subsequent pressure values are compared; and a communications interface, wherein the stored event statistics are accessible through the communications interface after the past operation of the maintenance pump.

* * * * *